United States Patent [19]

Bengtsson et al.

[11] 4,299,312

[45] Nov. 10, 1981

[54] ELECTROMAGNETIC TRACK BRAKE FOR A RAILWAY VEHICLE

[75] Inventors: Nils K. Bengtsson, Dalby; Bo B. Wikström, Malmö, both of Sweden

[73] Assignee: SAB Industri A.B., Landskrona, Sweden

[21] Appl. No.: 85,428

[22] Filed: Oct. 16, 1979

[30] Foreign Application Priority Data

Nov. 6, 1978 [SE] Sweden ..... 7811429

[51] Int. Cl.[3] ..... F16D 65/34

[52] U.S. Cl. ..... 188/165; 105/77

[58] Field of Search ..... 188/164, 165; 105/76, 105/77, 78

[56] References Cited

U.S. PATENT DOCUMENTS 2,564,945 8/1951 Zuckermann ..... 188/165

3,768,607 10/1973 Marzocco ..... 188/165

FOREIGN PATENT DOCUMENTS 928106 5/1955 Fed. Rep. of Germany .

2627794 1/1978 Fed. Rep. of Germany .

*Primary Examiner*—George E. A. Halvosa

*Attorney, Agent, or Firm*—Laurence R. Brown

[57] ABSTRACT

An electromagnetic track brake for a railway vehicle comprises an elongate brake energizing coil (1), an oval frame (2) thereabout, and a plurality of U-shaped shoes (3) mounted in a row on the frame. In order to improve the working characteristics and the stiffness of the track brake the lower branch of the frame (2) has a closed cross-section and an interlocking portion (15) extending down between the U-legs of the shoes (3). Interlocking elements are provided on both the frame and the shoes for transmitting braking reaction forces from the shoes to the frame.

7 Claims, 2 Drawing Figures

ELECTROMAGNETIC TRACK BRAKE FOR A RAILWAY VEHICLE

TECHNICAL FIELD

This invention relates to an electromagnetic track brake to be mounted on a railway vehicle for cooperation with a rail, the brake comprising an elongated brake energizing coil, a substantially oval frame therefore, and a plurality of generally U-shaped braking shoes mounted in a row on the frame and having braking surfaces disposed beneath the coil frictionally to engage the rail when the coil is energized.

BACKGROUND ART

Typical examples of earlier electromagnetic track brakes of this kind are shown in U.S. Pat. No. 3,768,607 and DE Pat. No. 928 106. Also in U.S. Pat. No. 2,564,945 and DE Pat. No. 2 627 794 examples are shown.

Different disadvantages may be found in all prior track brakes. A serious drawback common for the devices taken as examples of the prior art is that the means provided for taking care of the braking reaction forces in the frame and the shoes, which are individually movable to a certain extent, are not satisfactory, especially not if the length of the track brake is substantial, say 1 meter or more, or if the rail is irregular or has small radius curves. Prior art track brakes may even break down under severe working conditions due to a less favourable force and torque distribution in the frame and to deflections, which in prior art designs may be calculated to very high values.

The space available in the vehicle underframe for the track brake is often extremely limited, which eliminates simple solutions to the problem. A common requirement is also that the design shall be as cheap as possible but still extremely reliable under severe working conditions (for example a very harsh environment).

DISCLOSURE OF INVENTION

The disadvantages mentioned above are obviated and the different requirements are fulfilled if according to the invention the lower branch of the frame has a closed cross-secton, enclosing the coil, and a portion extending down between the legs of the shoes and if cooperating means are provided on said portion and on said legs for transmitting reaction forces from the shoes to the frame.

The frame will in this way get a very high moment of inertia, or in other words the frame will be very stiff against bending. An especially stiff design will be obtained if the lower part of said frame branch including said portion is shaped as a Y.

A further advantage as to vertical force transmission and space saving is obtained in that the inner surface of each shoe has a cross-sectional shape corresponding to said Y.

In a preferred embodiment the cooperating means are projections on said frame portion and corresponding, somewhat larger recesses in the legs of the shoes.

Very low force reaction points for the shoes are preferred, which may be attained in that the projections are provided at the lower edge of said frame portion.

In a practical embodiment there is a projection between neighbouring shoes, which are each provided with one half of the corresponding recess.

BRIEF DESCRIPTION OF THE DRAWING

The invention will be described in further detail below reference being made to the accompanying drawing, in which.

DESCRIPTION OF THE PREFERRED EMBODIMENT

An electromagnetic track brake of the kind illustrated is intended for suspension in a conventional way, not further elucidated, in a railway vehicle underframe for braking cooperation with the surface of a rail on which the vehicle runs. The total length of the track brake may vary as indicated, but is chosen, within the limits set by the available space, according to the requirements mainly as regards the braking capacity. A normal length for the brake may for example be 1 meter.

The main parts of the electromagnetic track brake are an elongate energizing coil 1, a substantially oval frame 2 therefore, and a plurality of generally U-shaped braking shoes 3 mounted in a row on the frame 2.

Figure 1:
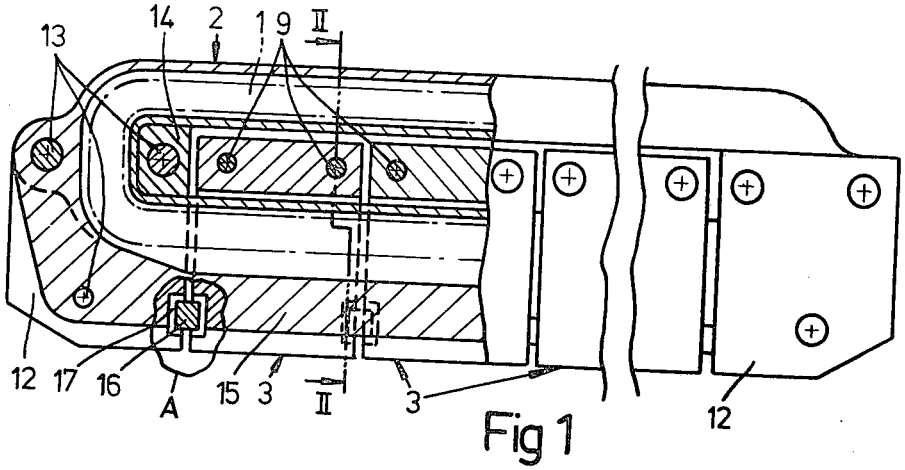
FIG. 1 is a side view, partly in section, of an electromagnetic track brake according to the invention

The coil 1, which for clarity reasons is only indicated by means of dash-dotted lines in FIG. 1, is completely conventional also as regards means (not shown) for its connection to an electrical source and suitable control means. The coil 1 is held in position in the frame 2 by means of an insulating filling means 4 (only shown in FIG. 2), which for example may be epoxy resin or any other suitable material inserted in the frame at a suitable stage of the manufacturing procedure.

The frame 2 is made of a non-ferromagnetic material, such as stainless steel, and may as shown be formed of two parts: a main part 5 and a cover 6, which is welded or secured in any other way to the main part after the insertion of the coil 1. The frame 2 may, however, quite as well be formed of several parts securely joined together, if that is more appropriate for productional reasons; it may for example be difficult to cast the whole main part 5 in one piece. At the discussion below of the frame 2 no limitation is to be applied by the production method indicated in the drawing.

Each shoe 3 consists of two halves 7 and 8 connected after mounting by means of screws 9 or the like. The shoes, which are made of a ferromagnetic material, will as shown surround the lower branch of the coil 1 and the frame 2. At the energizing of the coil 1 an electromagnetic flux will be flowing in the shoe 3 and will be closed through a rail 10 on which the vehicle runs and which is only indicated with dash-dotted lines in FIG. 2. The lower surfaces of each shoe 3 will thus cooperate with the rail 10 and constitute braking surfaces 11 frictionally engaging the rail surface, when the coil is energized.

It appears that the shoes 3 are not attached to the frame 2; further details about their freedom of movement and interaction with the latter will be given below. It may only here be noted that at each end of the frame 2 there are end plates 12 with a shape similar to that of the shoes 3, the plates 12 being attached by means of screws 13 to the frame 2 and to supports 14 placed between the two branches of the frame 2.

Figure 2:
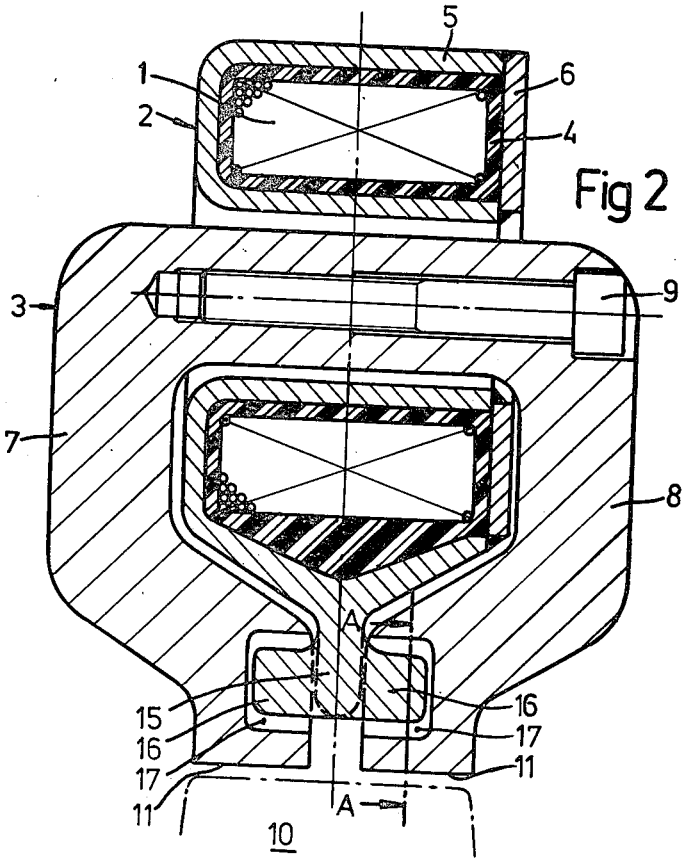
FIG. 2 is a cross sectional view, to a larger scale, along the line II—II in FIG. 1. A detail A in FIG. 1 is a cross-section substantially along the line A—A in FIG. 2.

One very important feature with the frame 2 is that its moment of inertia is very high, which in other words means that it is stiff and will deflect very little under high stresses but also that possible deflection will be distributed along the length of the frame 2. The high moment of inertia is accomplished on the one hand in that the lower branch of the frame 2 (surrounded by the shoes 3) has a closed profile (the main part 5 together with the cover 6), on the other hand in that the frame 2 has a portion 15 extending down between the legs of the shoes 3. In order to achieve as high a moment of inertia as possible the lower part of this frame is preferably shaped as a Y, as shown in FIG. 2.

Although it is suitable to have a cover 6 extending over both branches of the frame 2, especially the fixed cover for the lower branch is essential for attaining the desired high moment of inertia.

Each shoe 3 has an inner shape (FIG. 2) rather closely conforming to the outer shape of the frame 2, which among other things means that upwardly directed forces on the shoes 3 will be evenly distributed on the lower surface of the frame 2. The dimensioning is such as to ensure that no contact will occur between the shoes and the upper branch of the frame 2.

As shown, the frame portion 15 extending down between the legs of the shoes is provided with projections 16, preferably placed at the lower edge of the portion 15, whereas the legs of the shoes 3 have corresponding internal recesses, 17, which are somewhat larger than the projections 16 and will allow certain movements of the shoes 3. In the shown case there is a projection 16 between neighbouring shoes 3, and the corresponding recess 17 is formed as two halves in both these shoes, which is especially clear from detail A in FIG. 1, in which case however only the right hand shoe is movable.

The purpose of these cooperating means 16 and 17 is to transmit the braking reaction forces from the shoes 3 to the frame 2, as well the "normal" forces acting in the longitudinal direction of the brake as the forces acting perpendicular thereto resulting from rail irregularities and the like. As the projections 16 preferably are placed as close to the rail as possible the resulting torque will be minimized.

Modifications are possible within the scope of the appended claims. For example, the geometrical cross-sectional form of the frame 2 (and the shoe 3) may be varied to meet different requirements. The projections 16 may if required be covered by a possibly replaceable wear surface. Also the form and placement of the projections 16 and the recesses 17 may differ from the shown embodiment. It would even be possible to arrange the projections on the shoes and the recesses in the frame portion, provided that a magnetic short-circuit is prevented. In the shown embodiment, each shoe 3 is in two halves. Any other suitable design is possible, and the shoe may also be provided with detachable wearing parts, as is well known in the art.

We claim:

1. An electromagnetic track brake apparatus to be mounted on a railway vehicle for interaction with a ferromagnetic rail, the brake apparatus comprising in combination, a brake energizing coil disposed in an elongate oval frame of non-ferromagnetic material, braking shoe means comprising a set of ferromagnetic sections forming generally U-shaped brake shoe means having pole legs loosely surrounding the oval frame and coil therein for permitting relative motion of frame and shoe means and having the ends of the U-shaped shoe comprising braking surfaces disposed adjacent the rail to frictionally engage the rail by movement of the shoe means thereagainst when the coil is energized, said braking shoe means being movable about the loosely surrounded frame to thereby move said ends into frictional engagement with the rail and absorb braking forces, and means distributing braking forces between the shoe means and frame comprising interlocking means extending from the frame between said pole legs to near the ends of the U-shaped shoe including a projecting portion of predetermined shape, and cooperative interlocking means disposed substantially entirely between the pole legs within the U-shape of each said shoe section for engaging the projecting portion for transmitting braking forces from the braking shoe means to said frame, wherein the interlocking means and projecting portion in cross section is substantially Y-shaped.

2. Apparatus as defined in claim 1 wherein said U-shaped brake shoe means is disposed with the gap of said U being adjacent said rail so that the rail closes the magnetic loop of the brake shoe means thereby moving the braking shoe means into frictional contact with the rail when the coil is energized.

3. Apparatus as defined in claim 1 wherein the braking shoe means comprises a plurality of separate shoes disposed along the elongate oval frame.

4. Apparatus as defined in claim 1 wherein the braking shoe means comprise two interengageable sections forming said generally U-shaped brake shoe means.

5. Apparatus as defined in claim 4 wherein the projecting portion of the frame terminates in a lateral extension in opposite directions toward the respective interengageable sections with the sections interengaged having therebetween recesses surrounding lateral extensions of the projecting portion of the frame.

6. Apparatus as defined in claim 5 wherein the recesses have an area substantially half that of the projecting lateral extensions.

7. Apparatus as defined in claim 1 with said frame constructed to present a very high moment of inertia to reduce deflection by means of frame structure with a closed profile terminating in said Y-shaped cross section support structure with the projecting portion extending laterally into recessed shoe portions and the Y portion mating with a corresponding Y-shaped cavity between the shoe pole legs thereby to transmit force from the shoe to the frame on two separated surfaces of the frame structure.

* * * * *